US005482746A

United States Patent [19]

Liberti et al.

[11] Patent Number: 5,482,746

[45] Date of Patent: Jan. 9, 1996

[54] PHOSPHATING SOLUTION FOR METAL SUBSTRATES

[75] Inventors: Gianfranco Liberti, Abingdon; Kevin Brown, Feltham; Laurence Castle, Crawley, all of England

[73] Assignee: Brent Chemicals International Plc., Buckinghamshire, England

[21] Appl. No.: 43,576

[22] Filed: Apr. 7, 1993

[30] Foreign Application Priority Data

Apr. 8, 1992 [GB] United Kingdom ..... 9207725

[51] Int. Cl.[6] ..... B05D 3/02

[52] U.S. Cl. ..... 427/379; 148/253; 148/261; 148/262; 148/268; 427/409; 427/419.1; 427/435

[58] Field of Search ..... 427/419.1, 409, 427/435, 379, 419.7; 106/14.05; 148/253, 261, 262, 268

[56] References Cited

U.S. PATENT DOCUMENTS

| | | | |
|---|---|---|---|
| 4,120,702 | 10/1978 | Akerblom | 148/6.15 R |
| 4,130,431 | 12/1978 | Kogure | 106/14.33 |
| 4,881,975 | 11/1989 | Collier et al. | 427/409 |
| 5,135,583 | 8/1992 | Gehmecker et al. | 148/262 |
| 5,242,714 | 9/1993 | Steele | 427/279 |

FOREIGN PATENT DOCUMENTS

| | | |
|---|---|---|
| 0049077 | 4/1982 | European Pat. Off. . |
| 0478028 | 4/1992 | European Pat. Off. . |
| 2272192 | 12/1975 | France . |
| 2369352 | 5/1978 | France . |
| 54-130449 | 9/1979 | Japan . |
| 1198546 | 7/1970 | United Kingdom . |
| 1355739 | 6/1974 | United Kingdom . |
| 1478546 | 7/1977 | United Kingdom . |
| 2041987 | 9/1980 | United Kingdom . |
| 2201157 | 8/1988 | United Kingdom . |

OTHER PUBLICATIONS

Favilla J. R.—"No Rinse Treatment for Aluminium"—Product Finishing, 1990 (11): 45–55 (no month).

*Primary Examiner*—Janyce Bell

*Attorney, Agent, or Firm*—Harris, Wallen, MacDermott & Tinsley

[57] ABSTRACT

This invention relates to conversion coating of metal substrates which may comprise mixed metals such as steel, zinc or zinc based alloys or zinc aluminium alloy coated steel, aluminium or aluminium surfaces to provide a corrosion resistant surface which is subsequently coated with a paint coating.

The process of the invention comprises contacting the metal surface with an aqueous composition comprising silica, phosphoric acid and a divalent metal ion, the composition being substantially free of chromium and of any oxy metal anions which the metal has a valency of at least 5. The metal surface is subsequently cured by drying, or preferably by heating immediately after contact with the composition with no intermediate rinsing stage. A paint coating is then applied.

The process provides a painted surface, the coating providing an effective anti-corrosion coating and paint having good adhesion.

18 Claims, No Drawings

PHOSPHATING SOLUTION FOR METAL SUBSTRATES

This invention relates to conversion coating of metal substrates which may comprise steel, zinc or zinc based alloys or zinc aluminium alloy coated steel, aluminium or aluminium alloy surfaces to provide a corrosion resistant surface which can subsequently be coated with a paint coating.

In particular the invention relates to a dry-in-place metal coating process which is free of environmentally undesirable chromium and which will provide good results on the metal surfaces described above.

It is standard practice to form protective corrosion resistant coatings on the types of metal surfaces described above. As well as improving the corrosion resistance of the painted surface the coating should also have good mechanical properties, i.e. good paint adhesion to the metal surface and a degree of flexibility.

The conventional treatment of metals uses chromium based solution either for producing a conversion coating or for a final passivation rinse. A typical treatment sequence comprises cleaning (optionally with mechanical cleaning means or electro cleaning); rinsing; application of a chromate chemical composition or a phosphate coating composition comprising other metal ions in a conversion coating stage; rinsing, and; final passivation (chromium containing) or rinsing, which is followed by oven drying and paint application. Generally, the conversion coating solution is applied either by spray or immersion and subsequent rinsing steps are required. These processes are inconvenient because the series of process steps means that the treatment time is relatively long and in addition, because of the rinsing steps, significant problems of waste water and sludge disposal then arise.

In recent years, "dry-in-place" or "no rinse" processes have been developed in which a pre-treatment solution is applied to the metal surface and is subsequently cured by heat or radiation. Any paint coating is then directly applied over the resulting layer with no intermediate rinsing step. This type of process has considerable advantages as the number of steps in the process sequence is reduced and therefore less time is required to treat the metal surfaces. In addition large amounts of rinse water are not required and therefore the problem of their disposal does not arise.

The process speed becomes particularly important in on-line processes for example in coil-coating processes, where a continuous strip of sheet metal is uncoiled at the line entrance and recoiled at the exit, having been painted or otherwise treated. Line speeds can be up to 200 m/min. Thus, treatment times must be very short and a reduction in the number of process steps enables an desirable reduction of the line length. In addition, in such processes any coating composition imbalance, even if very promptly corrected could lead to huge losses and scrap, and therefore the coating compositions are preferably relatively simple and easily maintained.

However, conventional processes still include chromium metal ions which are undesirable from an environmental point of view. One widely used chromium containing dry-in-place treatment is described in GB 1234181.

EP-A-0478028 relates to providing crystalline zinc phosphate conversion coatings on metals. An initial activation step is used which tends to adversely affect the subsequent phosphating step. Silicate is therefore added to precipitate out any titanium ions which can then be removed from the phosphating composition. In this type of process, the phosphated surface is rinsed prior to paint coating and so the process described is not a dry-in-place conversion coating method.

Favilla J. R. —"No Rinse Treatment for Aluminium" Product Finishing, 1990 (11): 45–55 describes no-rinse processes. Generally the systems discussed are chromate containing however on page 50 non-chromium no-rinse treatments are described which are said to incorporate transition metals other than chromium.

GB 2041987 relates to chromate free solutions used for coating surfaces of aluminium or aluminium alloy for dry-in-place processes. The specification relates specifically to aluminium surfaces and the compositions do include transition metal additives which are oxy metal anions, also disadvantageous from an environmental point of view.

Chromate-free solutions are described in GB 2201157 in which silica products for treating surfaces are described. The application describes both no-rinse processes and systems which do involve a subsequent rinsing step. For the no-rinse treatment, a phosphating composition is described which comprises an aqueous dispersion of silica and an acidic trivalent metal compound. Oxy metal anions are specifically excluded from the composition and preferably also there is no divalent metal present.

Various compositions comprising silica and phosphoric acid are known for treating metal surfaces but not as pretreatment for permanent paint coatings. FR-A-2272192 relates to treating surfaces so that they will support lubricants for cold forming of steel and JP-A-54130449 describes the formation of an insulating film on an electrical steel sheet for use in magnetic cores, transformers and electric motors.

In order to provide an anti-corrosion coating on metal surfaces; which is suitable to be used as a base for subsequent paint coating, particular properties are required. In particular, the coating must provide good anti-corrosion properties which must not be adversely affected by the subsequent paint coat. In addition, the surface must be suitable to provide good adhesion for the paint coating.

The present invention aims to provide an effective dry-in-place chromium-free treatment.

Furthermore, the main components of the composition can be used across a range of steel, zinc or zinc alloys, aluminium or aluminium alloy metal substrates. Thus, metal processing of each of these metal surfaces can be effected with a minimum of composition changes.

In accordance with the present invention, a method is provided for coating a metal surface comprising in a first step contacting the metal surface with an aqueous composition comprising silica, phosphoric acid and a divalent metal ion, the composition being substantially free of chromium and of any oxy metal anions in which the metal has a valency of at least 5, and subsequently curing the coating metal substrate with no intermediate rinsing stage and in a second stage applying a second coating layer which is curable to form a fixed layer.

Preferably in the process of the present invention, the aqueous composition is also substantially free of trivalent metal ions.

Although silicon containing ions such as fluorosilicates are a well known component of conversion coating compositions, the use of silica is less well known and has an entirely different effect in a metal coating composition. In the present dry-in-place process, it is essential that after application of the composition to the pre-cleaned metal surface, the composition is cured. Curing is effected by drying, preferably be passing through an oven. Most preferably the metal should reach a PMT (peak metal temperature) of approximately 70 to 140 preferably 80° to 120° C. This ensures the reaction is completed between the phosphating liquid remaining on the surface of the metal and the metal surface itself, resulting in a coating which provides an effective anticorrosion surface for the subsequent application of a paint coating. Thus, the silica from the composition forms part of the coating.

In contrast in conversion coating processes which are not dry-in-place, although generally the metals are dried prior to application of paint coatings this is not essential and for example, if a water-based paint coating is applied, application can be carried out prior to drying.

In the present invention, the expression "substantially free of" is intended to mean that none of these components have been added to the composition and the presence of any of these components is no more than by their incidental inclusion in any of the other components. Preferably they are present in amounts below 100 ppm most preferably below 50 ppm, most preferably below 30 ppm.

In particular the compositions used in the process should be substantially free of chromium ions.

The presence of oxymetal anions in which the metal has a valency of 5 or more are specifically excluded from the compositions claimed. They are not only environmentally undesirable but in addition have been found to be detrimental to the corrosion resistance of the conversion coatings formed from the compositions used in the claimed coating process.

The quantities of the components in the composition can vary but are preferably chosen to suit the particular metal which is prevalent in the surface being treated and therefore depends upon whether the metal surface being treated is mainly steel, galvanised or aluminium (or aluminium/zinc alloy).

When the prevalent metal in the metal surface for coating is a galvanised metal the silica content is generally at least 0.01, preferably at least 0.05, and most preferably at least 0.1 moles/liter Generally the silica content is no greater than 1.0, preferably no greater than 0.5, and most preferably no greater 0.2 moles/liter. The total phosphate content in the composition is generally at least 0.02, preferably at least 0.05 and most preferably at least 0.1 moles/liter. Usually it is no greater than 0.5, preferably no greater than 0.2 and most preferably no greater than 0.1 moles/liter. The free phosphoric acid content is generally at least 0.02, preferably at least 0.03 and most preferably at least 0.05 moles/liter. Generally it will be no greater than 0.5, preferably up to 0.25 and most preferably up to 0.1 moles/liter. The amount of divalent metal ion in the composition is generally at least 0.001, preferably at least 0.01, and most preferably at least 0.025 moles/liter in the aqueous composition. Generally it will be no greater than 0.5, preferably no greater than 0.2 and most preferably no greater than 0.05 moles/liter (based on metal ion content).

For galvanised surfaces the preferred molar ratios of the components range from 1:1 to 1:0.7 for silica:total phosphate ion; around 1:3 to 1:5 for metal ions:total phosphate ion; and 1:2.5 to 1:7 for the metal ions:silica.

When the metal surface to be treated is predominantly aluminium or zinc/aluminium alloy, the optimum composition will generally comprise from at least 0.01, preferably at least 0.05 and most preferably at least 0.1 moles/liter silica. Generally the aqueous composition will include no greater than 1.0, preferably no greater than 0.5 and most preferably no greater 0.2 moles/liter.

For the total phosphate ion content, generally this will be at least 0.02, preferably at least 0.1 and most preferably at least 0.2 moles/liter. Generally the total phosphate content in the aqueous composition will be no greater than 2.0, preferably no greater than 0.5 and most preferably no greater than 0.25 moles/liter. The free phosphoric acid content is generally at least 0.02 preferably at least 0.03 and most preferably at least 0.04 moles/liter. Generally the free phosphoric acid content will be no greater than 0.5, preferably no greater than 0.2 and most preferably no greater than 0.1 moles/liter.

The metal ion content in the composition will generally be at least 0.001, preferably at least 0.03 and most preferably at least 0.05 moles/liter. Generally it will be present in an amount no greater than 0.5, preferably no greater than 0.2 and most preferably no greater than 0.1 moles/liter.

Thus in a composition for treating metal surfaces which are predominantly of aluminium or zinc/aluminium alloy, the preferred molar ratio of silica:total phosphate ion is in the range of about 1:0.8 to 1:1.5; the preferred ratio of divalent metal ions:total phosphate ion is in the range 1:2.5 to 1:5 and the preferred ratio of divalent metal ions:silica is in the range of about 1:2.5 to 1:3.

In particular, for use on aluminium surfaces, it is preferable that the aqueous composition should also include an activator preferably fluoride ions. Generally fluoride ions will be provided in the form of hydrogen fluoride. Fluoride may be present in amounts up to 0.5 moles/liter, preferably in amounts from 0.01 to 0.1 moles/liter and most preferably from 0.02 to 0.03 moles/liter. The addition of hydrogen fluoride to the composition may also contribute to the free acidity in the solution. Since hydrogen fluoride has a tendency to react with silica to produce fluoro silicate, when the composition includes hydrogen fluoride the composition is preferably prepared and stored in a two-pack form in which the contents of the two packs are mixed shortly prior to use. Thus, in the two-pack system the silica will be present in one of the packs and the hydrogen fluoride will be kept separate in the second pack. Preferably the first pack will comprise phosphoric acid, metal ion and hydrogen fluoride and the second pack will comprise silica. Preferably both are in the form of an aqueous based composition.

When the prevalent metal surface for coating is steel, the composition will generally contain at least 0.05, preferably at least 0.1 and most preferably at least 0.25 moles/liter silica, generally being no greater than 1.0, preferably no greater than 0.5 and most preferably a maximum of 0.35 moles/liter in the aqueous composition. The amount of total phosphate ion will generally be at least 0.05, preferably at least 0.1 and most preferably at least 0.5 moles/liter. Generally no greater than 2.0, preferably no greater than 1.0 and most preferably no greater than 0.5 moles/liter of the aqueous composition.

The free phosphoric acid content is generally at least 0.05 and preferably at least 0.1 moles/liter, generally being no greater than 0.5, preferably no greater than 0.3 and most preferably no greater than 0.2 moles/liter.

The metal ions will generally be present in an amount of at least 0.001, preferably at least 0.05 and most preferably at least 0.1 moles/liter, generally no greater than 1.0, preferably no greater than 0.5 and most preferably no greater than 0.2 moles/liter of the aqueous composition.

Thus, for treatment of predominantly steel surfaces, the preferred molar ratios for silica:total phosphate ion is in the range of about 1:1 to 1:2; for divalent metal ions:phosphate ion is preferably in the range of about 1:2.5 to 1:5; and for divalent metal ions:silica the molar ratio is preferably in the range of about 1:1 to 1:3.

Any divalent metal ion may be used as the divalent metal ion for use in the composition: divalent transition metal ions such as Mn, Co, Fe, Ni, Zn or alkaline earth divalent metal ions such as Mg, Ca, Sr, or Ba. Preferably the divalent metal ion is other than nickel for environmental reasons. Preferably calcium, zinc or magnesium ions are used to provide the divalent metal ion, most preferably calcium. They are generally added to the aqueous composition in the form of a non-interfering oxide, hydroxide or salt such as a carbonate. They may however, be added in the form of a phosphate salt, when an additional source of acid, such as hydrogen fluoride is present in the composition, thereby contributing to the phosphoric acid content in the composition. Alternatively the metal itself may be added to acidic composition to dissolve.

The silica particles are high surface area particles which are dispersed in solution to form a homogeneous, that is colloidal, dispersion (which can be clear or hazy) or capable of becoming dispersed in solution. The use of fume or precipitated silica, is preferred, especially those commercially available in the form of relatively high solids content viscous dispersions and in the form of silica sold under the trade names Aerosil (trade mark of Degussa). Mixtures of different forms of silica may be used if desired.

The phosphoric acid is generally added to the aqueous composition in the form of an aqueous solution for example a 50% active or higher aqueous solution. When an additional source of acid is present in the composition, phosphate ions may be added, for example, as divalent metal phosphate, thereby contributing phosphoric acid to the composition.

In particular in the compositions for treatment of galvanised metals or steel metal surfaces, preferably the composition also includes boric acid. When the prevalent metal surface for coating is galvanised, boric acid is generally present in an amount of at least 0.02, and most preferably at least 0.075 moles/liter. Generally the boric acid will be in an amount no greater than 0.5, preferably no greater than 0.2 and most preferably no greater than 0.1 in the aqueous composition. For steel surfaces, a slightly higher concentration of boric acid is preferred. Preferably this will be at least 0.05 and most preferably at least 0.1 moles/liter. Generally the amount will be no greater than 0.7, preferably no greater 0.4 and most preferably no greater than 0.2 moles/liter.

The aqueous compositions are prepared by the incorporation of the necessary ingredients into deionised water. The order of addition may be in any convenient way but is generally by firstly preparing a concentrate of the composition.

The present invention also includes a concentrate for a solution for metal coating comprising silica, phosphoric acid and a divalent metal ion, the concentrate being substantially free of chromium, any oxy metal anions in which the metal has a valency of at least 5 and any trivalent metal ions. The invention also includes a two-pack concentrate in which at least one of the components of the composition is in a first pack and at least one other component is in a second pack. In particular the invention comprises a two-pack concentrate in which the first pack comprises at least hydrogen fluoride and the second pack at least silica. The concentrate should include each of these components in a concentration so that dilution with water will produce the required end-use composition including the specific amounts of each component, as described above. Preferably, the end-use composition will comprise dilutions of a one or two-pack concentrate.

The compositions can be prepared by the addition of the components in any convenient order. It is generally convenient to mix the silica with at least a portion of the water prior to mixing with the remaining component of the composition. The remaining components can be added subsequently, optionally also dissolved in a portion of the water.

The invention is particularly aimed at providing a fast and efficient treatment for a coil coating metal conversion process.

For coil coating, the coating is generally applied by roll coating or reverse roll coating, or by passing the uncoiled metal sheet through a bath of the composition so that application is by immersion. However, any other standard application form can be used such as by spraying or conventional spray/dip treatment. Usually contact is at ambient temperature.

After application of the coating composition, the amount of teh composition may be controlled by passing the coated metal through Squeegee rolls optionally having an engraved surface. The amount of composition remaining on the metal surfaces should preferably be sufficient to produce a coating weight of from 0.25–5 g/m$^2$ after curing.

The metal to be treated is generally first cleaned and rinsed in a conventional manner. No activation step is necessary and the cleaned metal is then contacted with the coating composition.

The curing step comprises drying the coating. Generally curing is by heating and this may be carried out by conventional means, for example by passing the coil or coated article through an oven or exposing to IR radiation. Preferably the PMT reached on curing is from at least 60° C., preferably at least 70° C. most preferably at least 80° C., generally no greater than 140° C., preferably no greater than 120° C. and most preferably no greater than 100° C. Once the coated metal surface has been cured, the secondcaating layer, e.g. paint coating, can be immediately applied.

The present invention is a suitable anti-corrosion base coat for any curable second coating, in particular paint coatings. Suitable coating layers are for examples acrylate resins, polyester resins, silicon modified polyester resins, polyvinyl chloride based mixed polymers and fluorocarbon resins, in particular polyvinylidene fluoride or paints containing these materials. Paint coatings are generally applied in two layers: a primer layer, followed by a topcoat. Other suitable second coating materials are for example organic materials such as dispersions of resin powder in a plasticising medium, for example organosols such as polyvinylchloride plastisols. A primer coating may be applied prior to such a plastisol.

Alternatively the second coating may comprise for example an adhesive which can be applied as a liquid to which a smooth or textured laminate based on polymeric substances such as softened PVC or polytetrafluoroethylene can be adhered. Curing of the second coating layer generally comprises drying and optionally this is with the aid of heat or radiation. The second coating layer can be applied by any conventional method, for example for paint, generally by spraying, brushing or rolling.

The following examples illustrate the invention.

EXAMPLE 1

An aqueous concentrate was formed by mixing 1.01/moles phosphoric acid with water and subsequently adding and mixing 0.27 moles of calcium hydroxide. Separately, 0.58 moles of boric acid was mixed with water. The two aqueous solutions were mixed together and 1.25 moles Aerosil 200(trade mark) and deionised water were added to a total volume of 1000 ml. The solution was mixed in a Silverson (trade mark) mixer.

The resultant concentrate was a white acidic, viscous liquid.

A working solution was then prepared comprising 15% of this concentrate, the remaining 85% comprising deionised water.

The composition was applied to the surface of hot dip galvanised and electro galvanised metal plates. Prior to application of the coating composition, the metal plates had been treated by cleaning and demineralised rinsing. Application of the coating composition to the plates was by uniform wetting of the surface by Sheen spinner. The sheen spinner is a simple horizontal rotating plate (usually up to 1000 r.p.m.). The metal test plate was fastened to the rotating plate, brushed with the solution and rotated for a short time (usually 30 seconds to 1 min). In this way the liquid composition was evenly spread on the shole surface with consistent coating weight.

After application of the coating composition the coating was cured by oven drying at a temperature of 100° C. for 1 minute. The coating weights obtained were 0.15–0.3 g/m$^2$.

A paint coating was then directly applied over the resulting layer. The paint coatings used were:

a) A black polyester powder paint (produced by Croda) which was applied electrostatically and stoved at 210° C. with a thickness of 50 μm.

b) A chrome epoxy primer, followed by a white PVF (polyvinylidenefluoride) top-coat (produced by Beckers) were applied by bar coating in which a precision machined bar which is spirally engraved is rolled on the flat test panel, previously wet by the paint to be applied. The amount of paint remaining on the surface (so the paint thickness after curing) depends on the depth and width of the engraved spiral. Paint application was followed by stoving at a peak metal temperature (pmt) of 220° C. to give a primer coating of from 7 to 10 μm thick and a top coat of from 25 to 30 μm.

c) A stove enamel (produced by Trimite) was used to test protective coatings on aluminium. The enamel was applied by Sheen spinner and stoved at 170° C. to give a dry film thickness of 25–30 μm.

The coated, painted metal plates were then tested for corrosion and mechanical properties using the following tests:

Corrosion Tests

Corrosion resistance was evaluated by salt spray tests. Steel and galvanised metal plates were tested according to ASTM B117 and aluminium using acetic salt spray tests, according to ASTM B287.

Mechanical Tests

Test A

Mechanical properties were evaluated by cross cut adhesion tests in which the painted surface was engraved, by a sharp knife, with ten parellel cuts, 1.5 mm apart from each other. A further ten cuts were made, perpendicular to the former, so that a network of small squares, having 1.5 mm sides, resulted. Erichson indentated then followed, to see whether the coating and/or paint flaked from the metal plate and was continued to a depth at which adhesion losses begin to apear. Adhesion loss was detected by taping.

Test B

Reverse impact tests were carried out on each plate to British Standard 3900-E, in which a specified weight was allowed to fall from a preetermined height, onto the reverse side of a painted panel under testing. Paint adhesion was then checked by taping on the top of the resulting conical deformation.

Test C

T-bend tests were carried out on the powder coated paint surfaces by bending each plate by 180° C., so as to fold it back onto itself, tightly. This was followed by placing tape over each plate and evaluating the conversion coating/paint coating loss. For the paint coated plates according to b, T-bend stripline tests were carried out followed by taping and evaluation.

Scores out of 10 were given to each of the plates for each test performance. In each of these tests 10 signifies good results with no cracking or adhesion loss and 1 signifies considerable adhesion loss.

EXAMPLE 2

A two-pack concentrate composition was prepared: the first pack by mixing 1.31 moles phosphoric acid in water with 0.45 moles zinc carbonate followed by 0.16 moles hydrogen fluoride. The composition was made up to 1000 ml with deionised water. The second pack was prepared by adding de-ionised water to 1.25 moles or Aerosil 380 and mixing using a Silverson mixer. Water was added to a total volume of 1000 ml. The first pack formed a clear acidic solution and the second pack formed a white thixotropic neutral composition.

Immediately prior to use, the two-pack concentrate was mixed and a working composition was prepared comprising 15% of each concentrate, the remaining 70% comprising deionised water. The coating weights obtained were 0.15 to 0.3 g/m$^3$.

A selection of the tests set on in Example 1 were carried out on metal plate samples comprising cold rolled steel, aluminium, Galfan (trade mark) (95% zinc, 5% aluminium), Zalutite (trade mark) (45% zinc, 55% aluminium), hot dip galvanised and electrogalvanised metals.

EXAMPLE 3

An aqueous concentrate composition was prepared by dissolving 0.55 moles calcium hydroxide and 1.46 moles phosphoric acid in deionised water, 0.44 moles boric acid were added followed by 0.91 moles Aerosil 200 and deionised water to a total volume of 1000 ml, the composition being mixed in a Silverson mixer. The resultant composition was a white acidic thixotropic liquid. A working composition was prepared comprising 33% concentrate, the remainder being de-ionised water. The coating weights obtained were 0.6 to 0.8 g/m$^2$.

Corrosion and mechanical property tests were carried out as described in Example 1 on cold rolled steel metal plates.

Comparative Example A

A chromium containing metal treatment concentrate was prepared comprising 1.05 moles (105 parts by weight chromic acid), 16 parts by weight wheat starch, 1.67 moles (100 parts by weight) Aeorsil 350 (trade mark), 0.05 moles (5.53 parts) zinc carbonate and deionised water to a total 1000 parts. The pH of the composition was 3.0 and chromium VI:chromium III ratio was 0.55. A working composition was prepared comprising 25% concentrate, the remainder comprising deionised water. The coating weights obtained were 0.25–0.3 g/m$^2$ on cold rolled steel metal plates, 0.3 to 0.35 g/m$^3$ on galvanised plates and 0.4 to 0.45 g/m$^2$ on aluminium metal plates. Comparative tests for corrosion and mechanical properties were carried out as described in Example 1 for cold rolled steel, hot dip galvanised, electro galvanised and aluminium metal substrates.

Results

The results of the corrosion resistance tests are given in tables 1, 2 and 3. All of the corrosion resistance results indicate acceptable corrosion resistance properties.

The results of the mechanical property tests for each coating composition, and metal plate with paint coat a) are given in Table 4 and with paint coat b) in Table 5. The three results recorded in each case are for Tests A, B and C respectively.

As can be seen from the results in Tables 4 and 5 high mechanical performance is achieved using the compositions of the invention. The results also show that the composition of Example 1 is particularly preferred on galvanised surfaces, the composition of Example 2 is particularly preferred on aluminium surfaces and the composition of Example 3 is particularly preferred on steel surfaces. All of the results show performance approximately the same as using the conventional chromium based phosphating solution (comparative example A) but without the addition of this undesirable component.

In each case, it has been found that an increase in the strength of the working solution results in an increase of corrosion protection but a decrease in the adhesion of the protective layer to the metal. Thus the concentrations described above show the preferred amounts to achieve a balance between corrosion protection and mechanical properties.

TABLE 1

SALT SPRAY RESISTANCE ASTM B117
Average mm Paint Loss on Cross Hatch:
Powder Coat Paint Coating

| Metal Surface | Exposure Time (hrs) | Solution Ex. 1 | Ex. 2 | Ex. 3 | Ex.4 |
|---|---|---|---|---|---|
| Cold Rolled Steel | 336 | — | — | 2 | 1.5 |
| Electrogalvanised | 500 | 1 | — | — | 1 |
| Hot Dip galvanised | 336 | 1 | — | — | 1 |
| | 500 | 2 | — | — | <1 |
| Galfan* | 500 | — | 1 | — | <1 |
| Zalutite* | 500 | — | <1 | — | <1 |

TABLE 2

SALT SPRAY RESISTANCE ASTM B117
Average mm Paint Loss on cross Hatch:
Primer - PVF Coating

| Metal Surface | Exposure Time (hrs) | Solution Ex. 1 | Ex. 2 | Ex. 3 | Comp. Ex. |
|---|---|---|---|---|---|
| Cold Rolled Steel | 1000 | — | — | 3 | 2.5 |
| Electrogalvanised | 1000 | 3.5 | — | — | 3 |
| Hot Dip | 1000 | 1 | — | — | 1.5 |
| Galvanised | 1000 | — | 1 | — | 1 |
| Galfan* | 1000 | — | 1.5 | — | 1.5 |
| Zalutite* | | | | | |

*Galfan and Zalutite are trade marks

TABLE 3

ACETIC SALT SPRAY RESISTANCE ASTM B287
Average mm Paint Loss on Cross Hatch

| Metal Surface | Exposure Time hr | Solution Ex. 2 | Comp. Ex A |
|---|---|---|---|
| Aluminium (stove enamel) | 1000 | 1 | <1 |
| Aluminium (primer/top coat) | 2000 | <1 | <1 |

TABLE 4

MECHANICAL TESTS
Results for Powder Coat Paint Coating

| Metal Surface | Solution Ex. 1 | Ex. 2 | Ex. 3 | Comp. Ex. A |
|---|---|---|---|---|
| Aluminium | — | 8 9 10 | — | 6 7 9 |
| Cold Rolled Steel | 8 4 5 | — | 10 10 9 | 10 9 10 |
| Electrogalvanised | 10 9 10 | 9 3 4 | — | 10 7 10 |
| Hot Dip Galvanised | 10 9 10 | 9 4 9 | — | 10 8 9 |
| Galfan | 10 7 10 | 9 5 9 | — | 10 9 9 |
| Zalutite | 10 10 9 | 10 8 9 | — | 10 8 9 |

TABLE 5

MECHANICAL TESTS
Results for Primer and Top-Coat Paint Coating

| Metal Surface | Solution Ex. 1 | Ex. 2 | Ex. 3 | Comp. Ex. A |
|---|---|---|---|---|
| Aluminium | — | 10 9 8 | — | 10 7 9 |
| Cold Rolled Steel | 10 7 10 | — | 9 4 9 | 7 3 7 |
| Electrogalvanised | 10 6 9 | 10 3 6 | — | 9 6 10 |
| Hot Dip Galvanised | 8 7 9 | 9 2 7 | — | 10 6 10 |
| Galfan | 10 8 7 | 10 4 9 | — | 10 4 9 |
| Zalutite | — | 9 5 8 | — | 6 6 8 |

Comparative Examples B and C

The adverse effect of oxymetal anions in the coating composition is illustrated by the following comparative example.

Compositions B and C were prepared in deionised water as set out in table 6 below.

TABLE 6

| Component mole/l | Solution B mole/l | C mole/l |
|---|---|---|
| Silica (Aerosil 200) | 0.16 | 0.16 |
| Phosphoric acid (100%) | 0.81 | 0.81 |
| Boric Acid | 0.16 | 0.16 |
| Zinc ions (added as $ZnCO_3$) | 0.078 | 0.08 |
| Molybdic acid | 0.06 | — |

The compositions were each applied to cold rolled steel plates which had been brushed and cleaned with an alkali cleaner to a complete water-break free surface. Each composition was applied by the sheen spinner disc then stoved at 120° C. p.m.t. (peak metal temperature). A black polyester powder coating was applied electrostatically and stoved at 210° C. to a paint thickness of 50 μm.

Tests were carried out for corrosion (2 plates) and mechanical properties (1 plate) as described in example 1, using salt spray tests and mechanical tests A, B and C.

The results given in Table 7 show salt spray results as average mm of corrosion creepage from the cross-hatch, and maximum and minimum values are given in brackets, after 240 hours exposure to the salt spray test. The mechanical test results are in points out of 10 with high results indicating good properties.

TABLE 7

| Test | Solution B | Solution C |
|---|---|---|
| Salt Spray Test | | |
| Plate 1 | Total Loss | 2½ (1½–4) |
| Plate 2 | 7 (6–11) | 2 (1½–3) |
| Mechanical Properties | | |
| Test A | 9 | 8 |
| Test B | 10 | 6 |
| Test C | 9 | 5 |

As shown, although the addition of molybdate ions produces a benefit relating to the mechanical properties of the paint, it also results in a detrimental effect on the corrosion resistance. The concentrations used above are slightly higher than those of the working compositions of the present invention which are exemplified below. As also explained below in the present invention, increasing concentration has been found to increase corrosion protection and decrease mechanical properties which indicates that the corrosion protection obtained at the preferred concentrations of the invention would be so poor as to be unsuitable for practical use.

We claim:

1. A method for coating a metal surface by a coil coating process, the metal surface comprising predominantly galvanized metal and/or steel, the method comprising in a first step contacting the metal surface with an aqueous composition by immersion, the composition comprising silica, phosphoric acid and a divalent metal ion, the composition having a free phosphoric acid content of at least 0.02 moles/liter and being substantially free of chromium and of any oxy metal anions in which the metal has a valency of at least 5, the composition including boric acid in an amount from 0.02 to 0.7 moles/liter, and subsequently curing the coated metal substrate with no intermediate rinsing stage and in a second step applying a second coating layer which is curable to form a fixed layer.

2. A method according to claim 1 in which the aqueous composition is substantially free of trivalent metal ions.

3. A method according to claim 1 wherein the metal surface for coating comprises predominantly galvanised metal and in the aqueous composition the silica content is from 0.01 to 1.0 moles/liter, the total phosphate content is from 0.02 to 0.5 moles/liter, the free phosphoric acid content is from 0.02 to 0.5 moles/liter and the divalent metal ion content is 0.001 to 0.5 moles/liter (based on metal ion content).

4. A method according to claim 3 wherein the molar ratio of silica:total phosphate ions is from 1:1 to 1:0.7, the ratio of metal ions:total phosphate ions is from 1:3 to 1:5 and the ratio of metal ions:silica is from 1:2.5 to 1:7.

5. A method according to claim 1 or claim 2 in which the metal surface comprises predominantly steel and in the aqueous composition the silica content is from 0.05 to 1.0 moles/liter, the content of total phosphate ion is from 0.05 to 2.0 moles/liter, the free phosphoric acid content is from 0.05 to 0.5 moles/liter and the metal ion content is from 0.001 to 1.0 moles/liter.

6. A method according to claim 5 wherein the molar ratio of silica:total phosphate ions is from 1:1 to 1:2, the ratio of divalent metal ions:phosphate ions is from 1:2.5 to 1:5 and the ratio of divalent metal ions:silica is from 1:1 to 1:3.

7. A method according to claim 1 wherein the divalent metal ion comprises calcium, zinc and/or magnesium.

8. A method according to claim 1 in which the curing step is by passing the coated metal article through an oven at 80° to 100° C.

9. A method for coating a metal surface wherein the metal surface comprises predominantly galvanized metal, the method comprising in a first step contacting the metal surface with an aqueous composition comprising silica from 0.01 to 1.0 moles/liter, total phosphate ion content from 0.02 to 0.5 moles/liter, free phosphoric acid content from 0.02 to 0.5 moles/liter, and a divalent metal ion selected from Mn, Co, Fe, Zn, or alkaline earth metals from 0.001 to 0.5 moles/liter (based on metal ion content), the composition being substantially free of chromium and of any oxy metal anions in which the metal has a valency of at least 5, and subsequently curing the coated metal substrate with no intermediate rinsing stage, and in a second step applying a second coating layer which is curable to form a fixed layer.

10. A method according to claim 9 in which the aqueous composition is substantially free of trivalent metal ions.

11. A method according to claim 9 in which in the aqueous composition, the free phosphoric acid content is at least 0.05 moles/liter.

12. A method for coating a metal surface wherein the metal surface comprises predominantly aluminum or zinc/aluminum alloy, the method comprising in a first step contacting the metal surface with an aqueous composition silica from 0.01 to 1.0 moles/liter, total phosphate ion content from 0.02 to 2.0 moles/liter, free phosphoric acid content from 0.02 to 0.5 moles/liter, and a divalent metal ion selected from Mn, Co, Fe, Zn, or alkaline earth metals from 0.001 to 0.5 moles/liter (based on metal ion content), the composition being substantially free of chromium and of any oxy metal anions in which the metal has a valency of at least 5, and subsequently curing the coated metal substrate with no intermediate rinsing stage and in a second step applying a second coating layer which is curable to form a fixed layer.

13. A method according to claim 12 in which the aqueous composition is substantially free of trivalent metal ions.

14. A method according to claim 12 in which in the aqueous composition, the free phosphoric acid content is at least 0.05 moles/liter.

15. A method for coating a metal surface wherein the metal surface comprises predominantly steel, the method comprising in a first step contact the metal surface with an aqueous composition comprising silica from 0.05 to 1.0 moles/liter, total phosphate ion content from 0.05 to 2.0 moles/liter, free phosphoric acid content from 0.05 to 0.5 moles/liter, and a divalent metal ion selected from Mn, Co, Fe, Zn, or alkaline earth metals from 0.001 to 1.0 moles/liter (based on metal ion content), the composition being substantially free of chromium and of any oxy metal anions in which the metal has a valency of at least 5, and subsequently curing the coated metal substrate with no intermediate rinsing stage and in a second step applying a second coating layer which is curable to form a fixed layer.

16. A method according to claim 15 in which the aqueous composition is substantially free of divalent metal ions.

17. A method according to claim 15 in which in the aqueous composition, the free phosphoric acid content is at least 0.05 moles/liter.

18. A method for coating a metal surface comprising in a first step contacting the metal surface with an aqueous composition comprising silica, phosphoric acid and a divalent metal ion selected from Ca, Zn and Mg, the composition having a free phosphoric acid content of at least 0.05 moles/liter and being substantially free of chromium and of any oxy metal anions in which the metal has a valency of at least 5 and of trivalent metal ions, and subsequently curing the coated metal substrate with no intermediate rinsing stage and in a second step applying a second coating layer which is curable to form a fixed layer.

* * * * *